US012582188B2

(12) United States Patent
Briggs

(10) Patent No.: US 12,582,188 B2
(45) **Date of Patent: *Mar. 24, 2026**

(54) PROTECTIVE HELMET WITH MULTIPLE PSEUDO-SPHERICAL ENERGY MANAGEMENT LINERS

(71) Applicant: BELL SPORTS, INC., Scotts Valley, CA (US)

(72) Inventor: Eamon Briggs, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/960,489

(22) Filed: Nov. 26, 2024

(65) Prior Publication Data

US 2025/0082059 A1 Mar. 13, 2025

Related U.S. Application Data

(63) Continuation of application No. 17/513,247, filed on Oct. 28, 2021, now Pat. No. 12,171,294, which is a (Continued)

(51) Int. Cl.

| | |
|---|---|
| ***A42B 3/06*** | (2006.01) |
| ***A42B 3/12*** | (2006.01) |
| ***A42B 3/28*** | (2006.01) |

(52) U.S. Cl.

CPC ..... *A42B 3/064* (2013.01); *A42B 3/066* (2013.01); *A42B 3/12* (2013.01); *A42B 3/125* (2013.01); *A42B 3/28* (2013.01); *A42B 3/283* (2013.01)

(58) Field of Classification Search

CPC ..... A42B 3/064; A42B 3/283; A42B 3/066; A42B 3/125; A42B 3/28; A42B 3/12;

(Continued)

(56) References Cited

U.S. PATENT DOCUMENTS 3,156,921 A 11/1964 Dye
3,616,463 A 11/1971 Summers (Continued)

FOREIGN PATENT DOCUMENTS

CN 105357999 A 2/2016
EP 0790787 B1 9/2000

(Continued)

OTHER PUBLICATIONS

International Search Report and Written Opinion for related International Application No. PCT/US2016/069517, dated May 11, 2017.

(Continued)

*Primary Examiner* — Amy Vanatta
(74) *Attorney, Agent, or Firm* — Reed Smith LLP; Walter M. Egbert, III; Richard J. Brown

(57) ABSTRACT

A helmet comprising an outer liner and an inner liner slidably coupled to an interior surface of the outer liner is disclosed. The outer liner comprises an interior surface and the inner liner comprises an exterior surface. The inner liner is composed of an elastically deformable material. A majority of the interior surface of the outer liner and a majority of the exterior surface of the inner liner are both substantially parallel to a pseudo-spherical surface having a coronal cross section that is circular with a first radius and a sagittal cross section that is circular with a second radius different from the first radius. The inner liner is elastically deformable along the interior surface of the outer liner in response to rotation of the outer liner relative to the inner liner caused by an impact to the helmet.

8 Claims, 6 Drawing Sheets

Related U.S. Application Data continuation of application No. 16/399,650, filed on Apr. 30, 2019, now Pat. No. 11,172,719, which is a continuation of application No. 15/394,567, filed on Dec. 29, 2016, now Pat. No. 10,271,603.

(60) Provisional application No. 62/321,641, filed on Apr. 12, 2016.

(58) Field of Classification Search
CPC ..... A42B 3/128; A42B 3/10; A42B 3/124; A42B 3/121; A42B 3/063; A42B 3/127; A42B 3/281; A42B 3/069; A42B 3/06; A42B 3/062
USPC ..... 2/411, 412, 414
See application file for complete search history.

(56) References Cited

U.S. PATENT DOCUMENTS

| | | | | |
|---|---|---|---|---|
| 3,946,441 | A | 3/1976 | Johnson | |
| 4,012,794 | A | 3/1977 | Nomiyama | |
| 4,307,471 | A | 12/1981 | Lovell | |
| 5,309,576 | A | 5/1994 | Broersma | |
| 5,450,631 | A | 9/1995 | Egger | |
| 6,658,671 | B1 | 12/2003 | von Holst et al. | |
| 8,156,569 | B2 | 4/2012 | Cripton | |
| 8,296,863 | B2 | 10/2012 | Cripton | |
| 8,615,817 | B2 | 12/2013 | Phillips | |
| 8,863,319 | B2 | 10/2014 | Knight | |
| 8,955,169 | B2 | 2/2015 | Weber | |
| 9,032,558 | B2 | 5/2015 | Leon | |
| 9,060,561 | B2 | 6/2015 | Knight | |
| 9,089,180 | B2 | 7/2015 | Phipps | |
| 9,095,179 | B2 | 8/2015 | Kwan | |
| 9,119,433 | B2 | 9/2015 | Leon | |
| 9,271,536 | B2 | 3/2016 | Knight | |
| 9,414,635 | B2 | 8/2016 | Knight | |
| 9,516,909 | B2 | 12/2016 | Knight | |
| 10,362,829 | B2 * | 7/2019 | Lowe | A42B 3/128 |
| 10,602,794 | B2 * | 3/2020 | Thiel | A42B 3/127 |
| 11,766,085 | B2 * | 9/2023 | Weber | A42B 3/125 2/414 |
| 2001/0032351 | A1 | 10/2001 | Nakayama et al. | |
| 2002/0023291 | A1 | 2/2002 | Mendoza | |
| 2004/0250340 | A1 | 12/2004 | Piper | |
| 2010/0101005 | A1 | 4/2010 | Cripton et al. | |
| 2012/0060251 | A1 | 3/2012 | Schimpf | |
| 2012/0180201 | A1 | 7/2012 | Cripton | |
| 2012/0198604 | A1 | 8/2012 | Weber | |
| 2012/0208032 | A1 | 8/2012 | Faden | |
| 2012/0297526 | A1 | 11/2012 | Leon | |
| 2013/0000015 | A1 | 1/2013 | Marzec et al. | |
| 2013/0000018 | A1 | 1/2013 | Rudd et al. | |
| 2013/0019384 | A1 | 1/2013 | Knight | |
| 2013/0019385 | A1 | 1/2013 | Knight | |
| 2013/0025032 | A1 | 1/2013 | Durocher | |
| 2013/0040524 | A1 | 2/2013 | Halldin | |
| 2013/0042397 | A1 | 2/2013 | Halldin | |
| 2013/0061371 | A1 | 3/2013 | Phipps | |
| 2013/0185837 | A1 | 7/2013 | Phipps | |
| 2013/0247284 | A1 | 9/2013 | Hoshizaki | |
| 2013/0254978 | A1 | 10/2013 | McInnis et al. | |
| 2014/0013492 | A1 | 1/2014 | Bottlang | |
| 2014/0096311 | A1 | 4/2014 | Halldin | |
| 2014/0109299 | A1 | 4/2014 | Kwan | |
| 2014/0173810 | A1 | 6/2014 | Suddaby | |
| 2015/0074875 | A1 | 3/2015 | Schimpf | |
| 2015/0089722 | A1 | 4/2015 | Berry | |
| 2015/0089724 | A1 | 4/2015 | Berry | |
| 2015/0089725 | A1 * | 4/2015 | Lowe | A42B 3/125 2/410 |
| 2015/0157082 | A1 | 6/2015 | Weber | |
| 2015/0157083 | A1 | 6/2015 | Lowe | |
| 2015/0237946 | A1 | 8/2015 | Simpson | |
| 2015/0257472 | A1 | 9/2015 | Burek | |
| 2017/0013907 | A1 | 1/2017 | Salmini et al. | |
| 2017/0164678 | A1 | 6/2017 | Allen et al. | |
| 2017/0347736 | A1 | 12/2017 | Penner et al. | |
| 2017/0347743 | A1 | 12/2017 | Penner et al. | |
| 2018/0255861 | A1 | 9/2018 | Ho | |
| 2018/0255862 | A1 | 9/2018 | Ho | |
| 2018/0271198 | A1 | 9/2018 | Ku | |
| 2018/0317589 | A1 | 11/2018 | Mestas | |
| 2018/0343953 | A1 | 12/2018 | Erb et al. | |

FOREIGN PATENT DOCUMENTS

| | | | |
|---|---|---|---|
| EP | 1142495 | A1 | 10/2001 |
| EP | 2550886 | A1 | 1/2013 |
| EP | 2918184 | A1 | 9/2015 |
| EP | 2734071 | B1 | 6/2017 |
| WO | 1996014768 | A1 | 5/1996 |
| WO | 2001045526 | A1 | 6/2001 |
| WO | 2006022680 | A1 | 3/2006 |
| WO | WO2013/013180 | A1 | 1/2013 |
| WO | 2015089646 | A1 | 6/2015 |
| WO | 2017100775 | A1 | 6/2017 |

OTHER PUBLICATIONS

First Office Action for related Chinese patent application No. 201680084296.7; dated Jul. 15, 2020.

Second Office Action for related Chinese patent application No. 201680084296.7; dated Mar. 26, 2021.

Third Office Action for related Chinese patent application No. 201680084296.7; dated Aug. 23, 2021.

Extended European Search report for related European patent application No. 16898869.9, dated Jan. 21, 2020.

First Examination Report for related European patent application No. 16898869.9, dated Dec. 21, 2020.

Notice of Intention to Grant for related European patent application No. 16898869.9, dated Sep. 27, 2021.

Notice of Allowance for related Chinese patent application No. 201680084296.7; dated Jan. 30, 2022.

IPRP for PCT application PCT/US2012/047662, dated Jan. 21, 2014.

EP Search Opinion for EP2734071, dated Mar. 30, 2015.

* cited by examiner

PROTECTIVE HELMET WITH MULTIPLE PSEUDO-SPHERICAL ENERGY MANAGEMENT LINERS

RELATED APPLICATIONS

This application is a continuation of U.S. application Ser. No. 17/513,247, filed Oct. 28, 2021, which is a continuation of U.S. application Ser. No. 16/399,650, filed Apr. 30, 2019, now U.S. Pat. No. 11,172,719, issued Nov. 16, 2021, which is a continuation of U.S. application Ser. No. 15/394,567, filed Dec. 29, 2016, now U.S. Pat. No. 10,271,603, issued Apr. 30, 2019; which claims the benefit of U.S. provisional patent application No. 62/321,641, filed Apr. 12, 2016, titled "Protective Helmet with Multiple Pseudo-Spherical Energy Management Liners," the entirety of the disclosures of which are hereby incorporated by this reference.

TECHNICAL FIELD

Aspects of this document relate generally to protective helmets.

BACKGROUND

Protective headgear and helmets have been used in a wide variety of applications and across a number of industries including sports, athletics, construction, mining, military defense, and others, to prevent damage to a user's head and brain. Contact injury to a user can be prevented or reduced by helmets that prevent hard objects or sharp objects from directly contacting the user's head. Non-contact injuries, such as brain injuries caused by linear or rotational accelerations of a user's head, can also be prevented or reduced by helmets that absorb, distribute, or otherwise manage energy of an impact. This may be accomplished using multiple layers of energy management material.

Conventional helmets having multiple energy management liners are able to reduce the rotational energy transferred to the head and brain by facilitating the rotation of the energy management liners against one another. Shaping the interface between energy management liners to have spherical symmetry would facilitate such a rotation. However, the consequences of such symmetry may include larger size, an undesirable length to width ratio, and/or decreased effectiveness due to insufficient energy management material.

Some conventional helmets, such as, for example, that disclosed in US Published application 20120060251 to Schimpf (hereinafter "Schimpf"), include a continuous interface surface between an inner liner and the outer liner. However, conventional helmet designs configured in this way are conventionally manufactured for football helmets, and are not suitable for conventional bicycle helmets where a large portion of the helmet is required to have air flow openings and gaps extending from the innermost area of the helmet through all energy management liners.

Furthermore, some conventional helmets, including some embodiments disclosed in Schimpf, employ a continuous surface interrupted by a recess in the outer liner that a projection from the inner liner extends into. Some conventional helmets employ structures or objects that bridge energy liners that must break or deform for the liners to rotate against each other. Such a method of energy absorption is disadvantageous; while the energy is absorbed by the failure or deformation of the projections, it happens over a short period of time, thus doing little to attenuate the rotational accelerations experienced by the user's head and brain.

SUMMARY

According to an aspect of the disclosure, a helmet may comprise an outer liner having an interior surface and a plurality of vents passing through the outer liner, and an inner liner composed of an elastically deformable material and slidably coupled to the interior surface of the outer liner, the inner liner having an exterior surface and a plurality of channels passing through the inner liner, wherein the plurality of channels at least partially overlap with the plurality of vents to form a plurality of apertures from outside the helmet to inside the helmet, the interior surface of the outer liner comprises at least one ridge proximate an edge of the inner liner, the inner liner being directly coupled to the at least one ridge, wherein a majority of the interior surface of the outer liner and a majority of the exterior surface of the inner liner are both substantially parallel to a pseudo-spherical surface having a coronal cross section that is circular with a first radius and a sagittal cross section that is circular with a second radius different from the first radius, wherein the interior surface of the outer liner and the exterior surface of the inner liner are separated by the pseudo-spherical surface, and wherein the inner liner is elastically deformable along the interior surface of the outer liner in response to rotation of the outer liner relative to the inner liner caused by an impact to the helmet.

Particular embodiments may comprise one or more of the following features. Each of the plurality of vents may be beveled at the interior surface of the outer liner, and each of the plurality of channels may be beveled at the exterior surface of the inner liner. The inner liner may be directly coupled to the interior surface of the outer liner through at least one return spring, the at least one return spring composed of an elastomer material. At least one of the interior surface of the outer liner and the exterior surface of the inner liner may comprise a surface of reduced friction. An air gap may exist between a majority of the exterior surface of the inner liner and the interior surface of the outer liner. The outer liner may have a density greater than 100 g/L, and the elastically deformable material of the inner liner has density less than 70 g/L.

According to an aspect of the disclosure, a helmet may comprise an outer liner having an interior surface, and an inner liner composed of an elastically deformable material and slidably coupled to the interior surface of the outer liner, the inner liner having an exterior surface, wherein a majority of the interior surface of the outer liner is pseudo-spherical, having a coronal cross section that is circular with a first outer radius and a sagittal cross section that is circular with a second outer radius different from the first outer radius, wherein a majority of the exterior surface of the inner liner is pseudo-spherical, having a coronal cross section that is circular with a first inner radius and a sagittal cross section that is circular with a second inner radius different from the first inner radius, wherein a difference between the first outer radius and the first inner radius is less than 7 mm, wherein a difference between the second outer radius and the second inner radius is less than 7 mm, and wherein the inner liner is elastically deformable along the interior surface of the outer liner in response to rotation of the outer liner relative to the inner liner caused by an impact to the helmet.

Particular embodiments may comprise one or more of the following features. The outer liner may comprise a plurality of vents passing through the outer liner, each vent of the plurality of vents beveled at the interior surface of the outer liner, the inner liner may comprise a plurality of channels passing through the inner liner, each channel of the plurality of channels beveled at the exterior surface of the inner liner, and the plurality of channels at least partially overlap with the plurality of vents to form a plurality of apertures from outside the helmet to inside the helmet. The interior surface of the outer liner may comprise at least one ridge proximate an edge of the inner liner, the inner liner being directly coupled to the at least one ridge. The inner liner may be directly coupled to the interior surface of the outer liner through at least one return spring, the at least one return spring composed of an elastomer material. The outer liner may further comprise at least one chin bar anchor. An air gap may exist between a majority of the exterior surface of the inner liner and the interior surface of the outer liner. The outer liner may have a density greater than 100 g/L, and the elastically deformable material of the inner liner has a density less than 70 g/L.

According to an aspect of the disclosure, a helmet may comprise an outer liner having an interior surface, and an inner liner comprising an elastically deformable material and slidably coupled to the interior surface of the outer liner, the inner liner having an exterior surface, wherein a majority of the interior surface of the outer liner and a majority of the exterior surface of the inner liner are both substantially parallel to a pseudo-spherical surface having a coronal cross section that is circular with a first radius and a sagittal cross section that is circular with a second radius different from the first radius, and wherein the inner liner is elastically deformable along the interior surface of the outer liner in response to rotation of the outer liner relative to the inner liner caused by an impact to the helmet.

Particular embodiments may comprise one or more of the following features. The outer liner may comprise a plurality of vents passing through the outer liner, the inner liner may comprise a plurality of channels passing through the inner liner, and the plurality of channels may at least partially overlap with the plurality of vents to form a plurality of apertures from outside the helmet to inside the helmet. Each of the plurality of vents may be beveled at the interior surface of the outer liner, and each of the plurality of channels may be beveled at the exterior surface of the inner liner. The interior surface of the outer liner may comprise at least one ridge proximate an edge of the inner liner, and the inner liner may be directly coupled to the at least one ridge. The inner liner may be directly coupled to the interior surface of the outer liner through at least one return spring, the at least one return spring composed of an elastomer material. At least one of the interior surface of the outer liner and the exterior surface of the inner liner may comprise a surface of reduced friction. An air gap may exist between a majority of the exterior surface of the inner liner and the interior surface of the outer liner.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶ 6. Thus, the use of the words "function," "means" or "step" in the Detailed Description or Description of the Drawings or claims is not intended to somehow indicate a desire to invoke the special provisions of 35 U.S.C. § 112, ¶ 6, to define the invention. To the contrary, if the provisions of 35 U.S.C. § 112, ¶ 6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . " if the claims also recite any structure, material or acts in support of that means or step, or that perform the recited function, then it is the clear intention of the inventors not to invoke the provisions of 35 U.S.C. § 112, ¶6. Moreover, even if the provisions of 35 U.S.C. § 112, ¶6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DETAILED DESCRIPTION

Figure 1A:
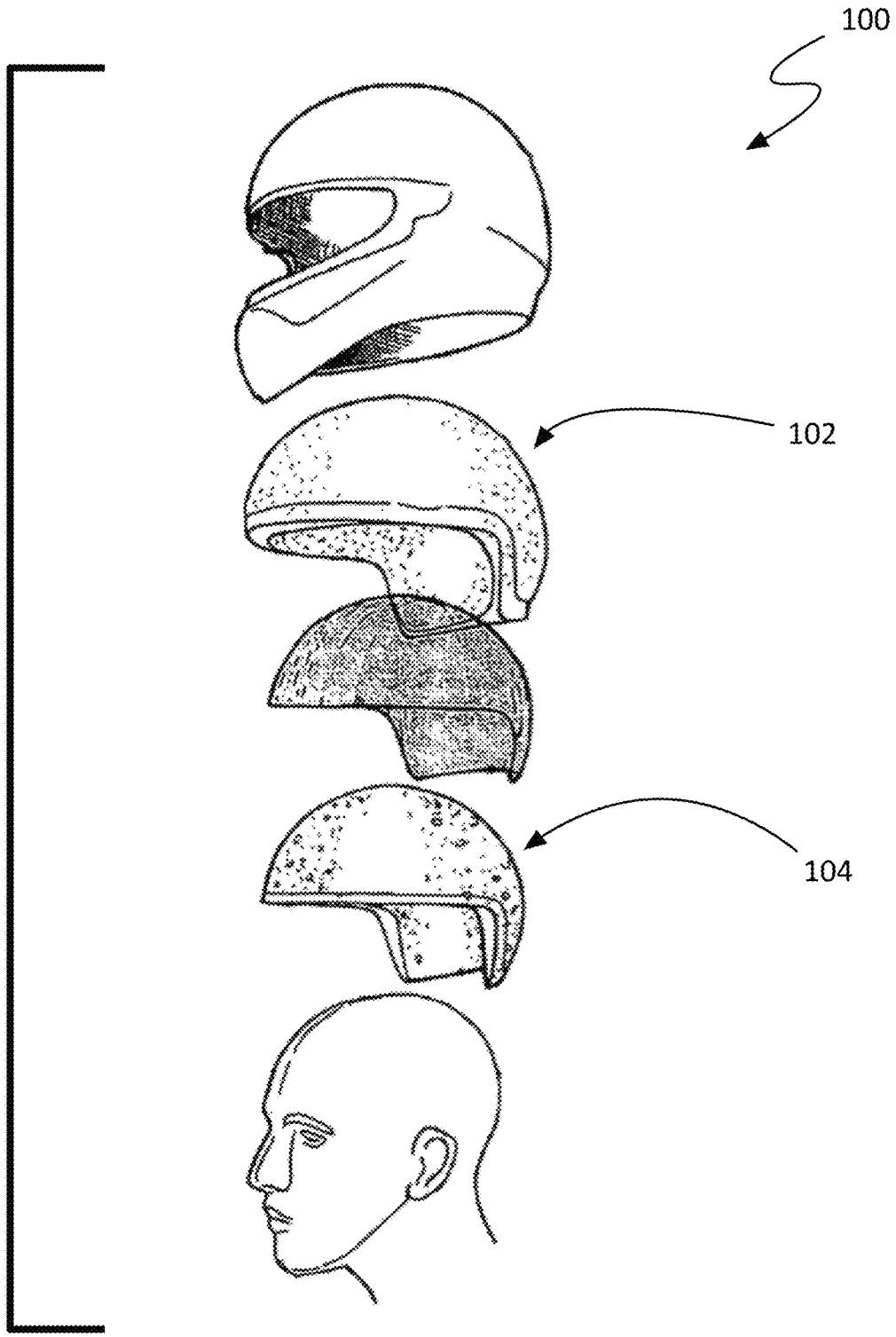
FIG. 1A (Prior Art)
FIGS. 1A and 1B show embodiments of a helmet with multiple energy management liners as known in the prior art.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Conventional helmets having multiple energy management liners reduce the rotational energy of an impact transferred to the head and brain by facilitating the rotation of the energy management liners against one another. Shaping the interface between energy management liners to have spherical symmetry, essentially forming a ball joint interface, would facilitate such a rotation.

However, there are consequences of that spherical symmetry. By requiring the energy management liners to interface with each other along a spherical surface, sacrifices are often made. To compensate for the spherical interface, either the helmet is made larger and/or more spherical overall to accommodate the spherical interface between liners, or segments of the liners may be made too thin to be effective. For example, a helmet with a conventional form factor and a spherical interface between liners might have an inner liner that is too thin at the front and back of the user's head for adequate protection, and an outer liner too thin along the sides. Additionally, these constraints may result in a helmet design that is difficult, if not impossible, to manufacture.

Additionally, some conventional helmets include a continuous interface surface between an inner liner and the outer liner. See, for example, FIG. 1A, which shows a helmet 100 with a continuous outer liner 102 and a continuous inner liner 104, similar to the helmet shown in FIG. 5 of the prior art reference to Schimpf. However, conventional helmet designs configured in this way are conventionally manufactured for football helmets, and are not suitable for conventional bicycle helmets where a large portion of the helmet is required to have air flow openings and gaps extending from the innermost area of the helmet through all energy management liners.

Figure 1B:
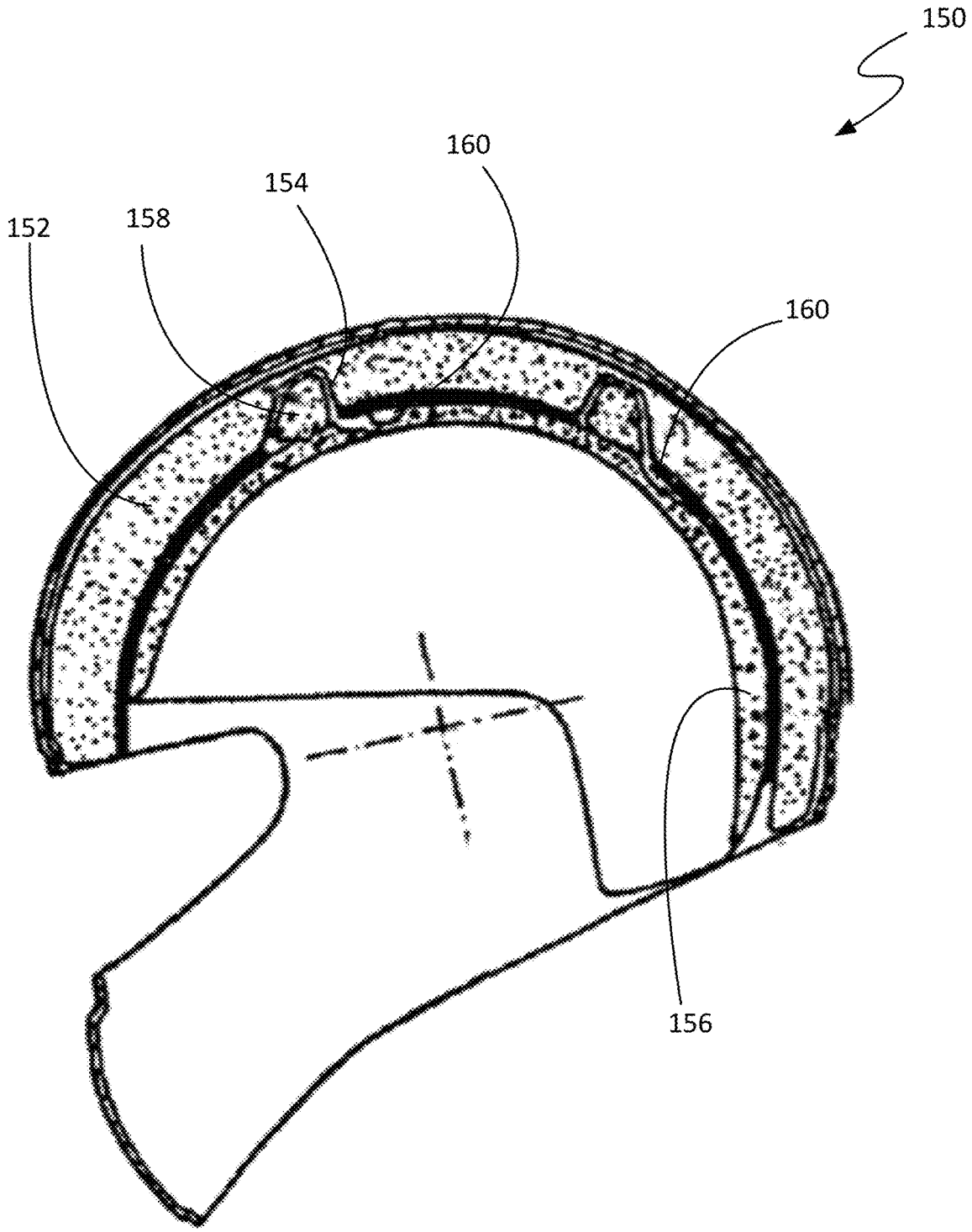
FIG. 1B (Prior Art)

Furthermore, some conventional helmets employ a continuous surface interrupted by a recess in one liner that a projection from another liner extends into, limiting the ability of one liner to rotate with respect to the other. Some conventional helmets also employ structures designed to break to absorb impact energy. See, for example, FIG. 1B, which shows a helmet 150 with an outer liner 152 having two recesses 154 and two predetermined breaking points 160 and an inner liner 156 having two projections 158, each extending into a recess 154, similar to the helmet shown in FIG. 17 of Schimpf. Some conventional helmets employ structures or objects that bridge energy liners that must break or deform for the liners to rotate against each other. One disadvantage of such a method is that, while the energy may be absorbed by the failure or deformation of the breaking points, it happens over a short period of time, thus doing little to attenuate the rotational accelerations/decelerations experienced by the user's head and brain.

Contemplated as part of this disclosure are helmets having multiple energy management liners that are pseudo-spherical in nature, yet still able to effectively rotate against one another upon impact. Specifically, by using at least one flexible inner energy management liner shaped to interface with another liner along a pseudo-spherical surface, a protective helmet may retain a desirable length to width ratio and size, while effectively attenuating rotational energy. FIGS. 2-5 depict a non-limiting embodiment of a helmet 200 comprising an outer liner 202 and an inner liner 204. The interior surface 300 of the outer liner 202 and the exterior surface 302 of the inner liner 204 interface with each other across a pseudo-spherical surface 400. This is advantageous to conventional helmets using a spherical interface, since the pseudo-spherical interface allows the helmet to retain a pleasing form factor without sacrificing crucial liner thickness.

Furthermore, the inner liner 204 is composed of an elastically deformable material. Upon impact, rotational energy is absorbed by the inner liner 204, which deforms to conform to pseudo-spherical interior surface 300 of the outer liner 202 as the outer liner 202 rotates with respect to the inner liner 204. This is advantageous to conventional helmets, such as helmet 150 of FIG. 1B, which absorb rotational energy through the failure or deformation of projections or other structures bridging energy management liners. In contrast to the sharp decelerations and sharply localized energy absorption associated with helmets such as helmet 150, the elastic deformation of the inner liner 202 absorbs the rotational energy across a significant portion of the liner over a longer time than a failing projection, resulting in better attenuation of the rotational acceleration/deceleration of the user's head and brain.

Figure 3:
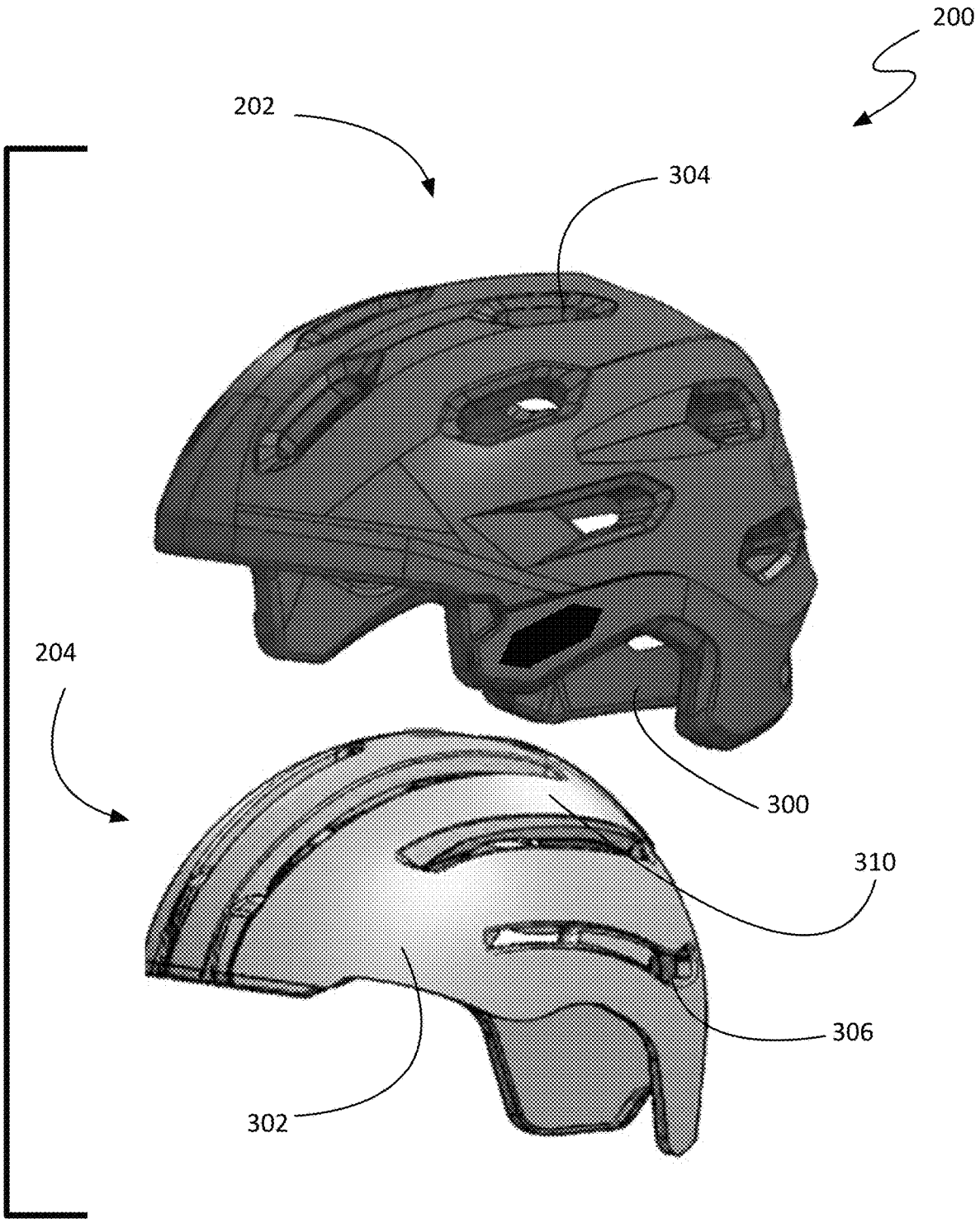
FIG. 3 is an exploded view of the helmet of FIG. 2.

FIG. 3 shows an exploded view of a non-limiting example of a helmet 200 having multiple pseudo-spherical energy management liners. As shown, helmet 200 has an outer liner 202 and an inner liner 204, which is slipably coupled to the interior surface 300 of the outer liner 202, according to various embodiments. In other embodiments, additional liners may be included.

Reference is made herein to inner and/or outer liners comprising an energy management material. As used herein, the energy management material may comprise any energy management material known in the art of protective helmets, such as but not limited to expanded polystyrene (EPS), expanded polyurethane (EPU), expanded polyolefin (EPO), expanded polypropylene (EPP), or other suitable material.

An outer liner 202 is exterior to the inner layer of a helmet and is composed, at least in part, of energy management materials. In some embodiments, the exterior surface of the outer liner 202 may comprise an additional outer shell layer, such as a layer of stamped polyethylene terephthalate (PET) or a polycarbonate (PC) shell, to increase strength and rigidity. This shell layer may be bonded directly to the energy management material of the outer liner 202. In some embodiments, the outer liner 202 may have more than one rigid shell. For example, in one embodiment, the outer liner 202 may have an upper PC shell and a lower PC shell.

According to various embodiments, the outer liner 202 may be the primary load-carrying component for high-energy impacts. As such, the outer liner 202 may be composed of a high-density energy management material. As a specific example, the outer liner may be composed of EPS. In some embodiments, the density of the energy management material of the outer liner may be greater than 100 g/L. In other embodiments, the density of the energy management material of the outer liner 202 may be greater than 106 g/L.

Figure 2:
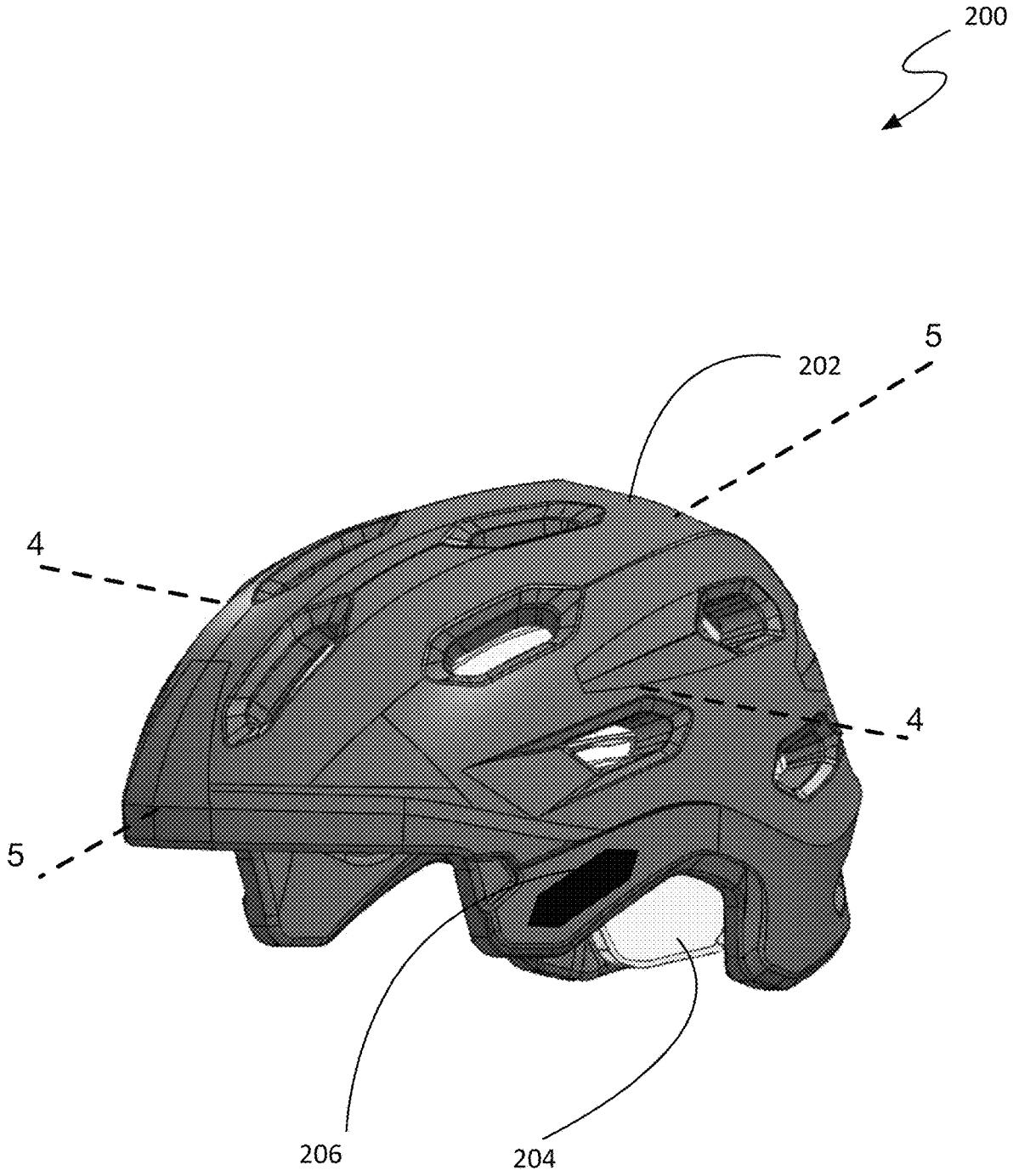
FIG. 2 is a perspective view of a helmet.

The outer liner 202 may provide a rigid skeleton for the helmet 200, and as such may serve as the attachment point for accessories or other structures. For example, as shown in FIGS. 1 and 2, the outer liner 202 may include one or more anchors 206 for a removable chin bar. Interfacing the outer liner 202 with an inner liner 204 along a pseudo-spherical surface allows the outer liner 202 to be made with sufficient thickness that accessories and mounts, such as the chin bar anchors 206, may be incorporated without resorting to an unfavorable helmet shape and/or size.

An inner liner 204 refers to an energy management liner of a helmet that is, at least in part, inside of another liner, such as outer liner 202 or another inner liner. The inner liner 204 may be composed of elastically deformable energy management material, such that it may deform to conform to an interior surface of an enclosing liner (e.g. interior surface 300 of outer liner 202, etc.) in response to the enclosing liner rotating with respect to the inner liner. As such, the inner liner 204 may be composed of a low-density energy management material that is flexible and able to rebound when impacted or squeezed. In particular, the inner liner 204 may be composed of EPP. In some embodiments, the density of the energy management material of an inner liner 204 may be 65 g/L. In other embodiments, the density may be between 62 and 68 g/L. In still other embodiments, the density may be less than 70 g/L.

According to various embodiments, an inner liner 204 is elastically deformable, such that it may deform to conform to an interior surface of an enclosing liner, such as outer liner 202. Helmets help to protect users from impacts that vary in intensity, sometimes ranging from mild to severe. Some helmets need to be replaced after absorbing a very intense impact, but can absorb low to moderate impacts without substantial degradation of effectiveness. In the context of the present description and the claims that follow, elastically deformable means that the deformation experienced by the inner liner while conforming to the interior surface of a rotating, enclosing liner as a result of the strongest impact a helmet may absorb without needing to be replaced is reversible. In other words, an inner liner of a helmet is composed of a material that is elastically deformable such that deformations experienced during typical, rather than extreme, use cases for that particular helmet are reversible, such that the inner liner may be returned to a pre-impact geometry and position.

Although not shown in FIG. 2, the helmets of this disclosure may comprise any other features of protective helmets previously known in the art, such as but not limited to straps, comfort liners, masks, visors, and the like. For example, in one embodiment, the inner liner 204 may include a fit system to provide improved comfort and fit.

The attenuation of rotational energy occurs when the exterior surface 302 of the inner liner 204 and the interior surface 300 of the outer liner 202 rotate against each other. As previously noted, a spherical interface between those two surfaces would be advantageous for such a rotation, but would come at a cost. According to various embodiments disclosed herein, the interface between the exterior surface 302 of the inner liner 204 and the interior surface 300 of the outer liner 202 is pseudo-spherical in nature. In the context of the present description and the claims that follow, a pseudo-spherical surface is a surface having two circular cross sections which share the same central axis, though not necessarily the same central point. The cross sections will have different radii.

Figure 4:
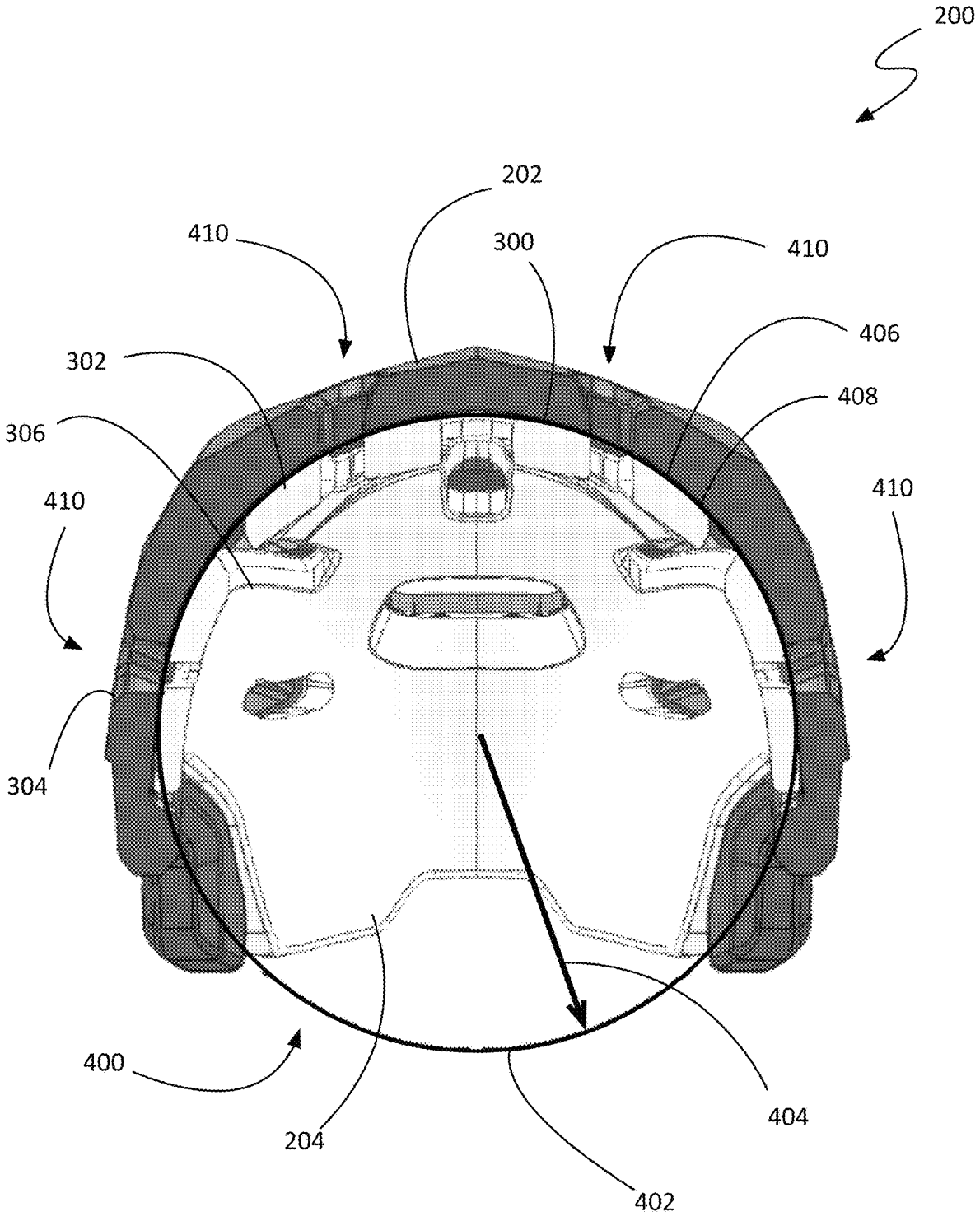
FIG. 4 is a front cross-sectional view of the helmet of FIG. 2 taken along cross-section line 4-4.
Figure 5:
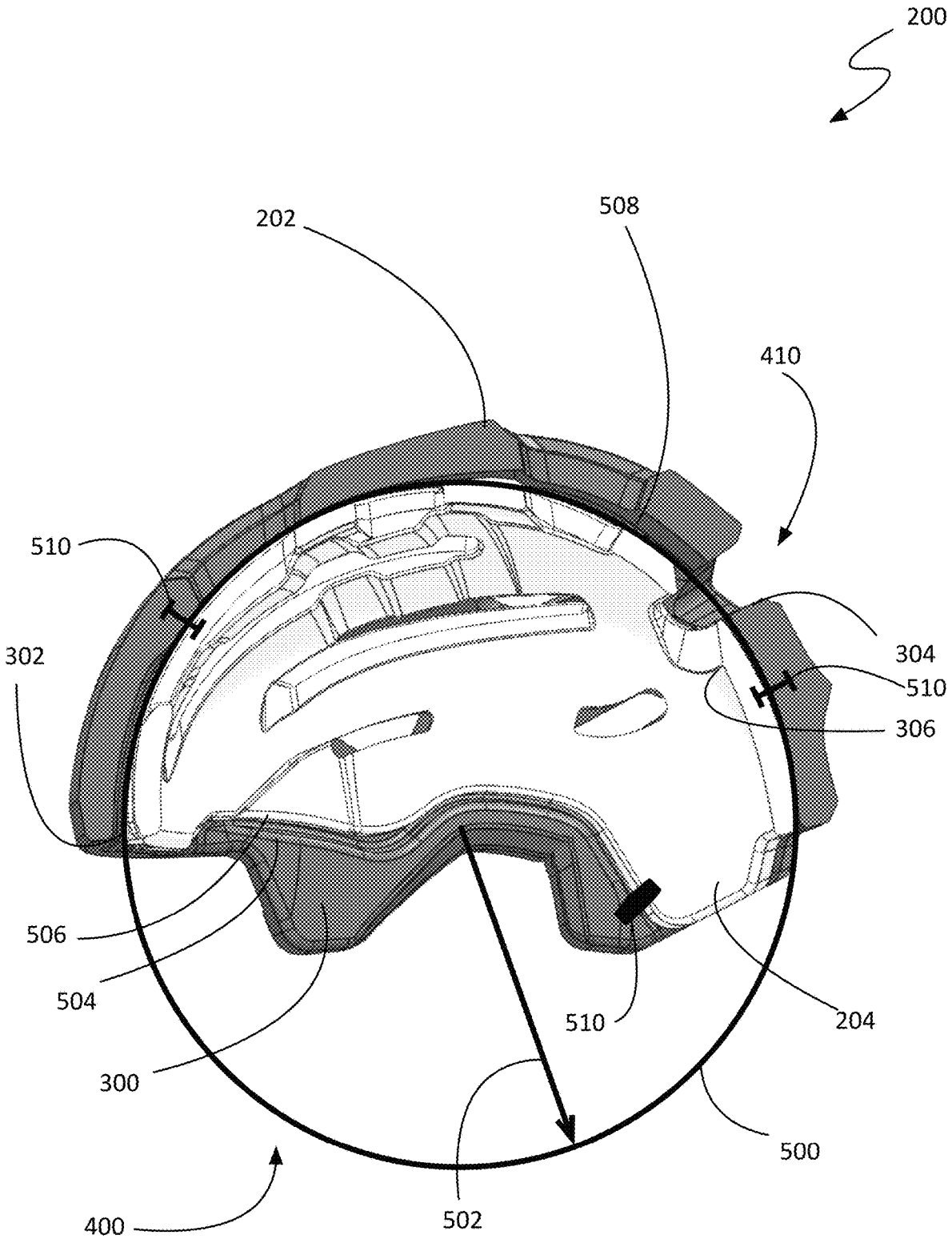
FIG. 5 is a side cross-sectional view of the helmet of FIG. 2 taken along cross-section line 5-5.

In some embodiments, the two circular cross sections of a pseudo-spherical surface exist in spherical planes perpendicular to each other. See, for example, the non-limiting example of a pseudo-spherical surface 400 shown in FIGS. 4 and 5. FIG. 4 shows a cross sectional view of a helmet 200, the cross section being taken along a coronal plane. As shown, the pseudo-spherical surface 400 has a circular coronal cross section 402 having a first radius 404. FIG. 5 shows a cross-sectional view of helmet 200 taken along a sagittal plane. As shown in FIG. 5, pseudo-spherical surface 400 has a circular sagittal cross section 500 having a second radius 502, which is larger than the first radius 404. The coronal cross section 402 is perpendicular to the sagittal cross section 500.

For the purposes of the following discussion regarding the shape of the surfaces, the interior surface 300 of an outer liner 202 does not include any surfaces that make up a vent 304, but rather is limited to the outermost surface of the outer liner 202 that is facing toward the head of a user. Similarly, the exterior surface 302 of an inner liner 204 does not include any surfaces that make up a channel 306, but rather is limited to the outermost surface of the inner liner 204 that is facing away from the head of a user. Furthermore, for the purpose of the following discussion regarding the shape of the surfaces, the shapes upon which the surfaces rest may also be thought to extend over any voids (e.g. vents 304, channels 306, etc.) and may be considered continuous shapes. According to various embodiments, the interior surface 300 and the exterior surface 302 may be pseudo-spherical in nature, or at least approximately pseudo-spherical.

In some embodiments, a majority 406 of the interior surface 300 of the outer liner 202, as well as a majority 408 of the exterior surface 302 of the inner liner 204 are both substantially parallel to a pseudo-spherical surface 400. In the context of the present description and the claims that follow, two surfaces are parallel when, for each point (herein after an overlap point) on a first surface whose normal line (i.e. the line normal to the plane tangent to that point on the surface) intersects with a second surface, the normal line of the overlap point is also the normal line for a counterpart point on the second surface. Additionally, in the context of the present description and the claims that follow, two surfaces are substantially parallel when, for a majority of overlap points on a first surface, the angle between the normal line of the overlap point and the normal line of the counterpart point on the second surface is less than 15 degrees.

In other embodiments, at least a majority 406 of the interior surface 300 of the outer liner 202, as well as at least a majority 408 of the exterior surface 302 of the inner liner 204 may both be described as pseudo-spherical surfaces, though not necessarily identical surfaces. For example, the radii of their cross sections may be different. Specifically, in some embodiments, a majority 406 of the interior surface 300 of the outer liner 202 is pseudo-spherical, having a coronal cross section that is circular with a first outer radius and a sagittal cross section that is circular with a second outer radius different from the first outer radius. Additionally, a majority 408 of the exterior surface 302 of the inner liner 204 is pseudo-spherical, having a coronal cross section that is circular with a first inner radius and a sagittal cross section that is circular with a second inner radius different from the first inner radius. In one embodiment, the difference between the first outer radius and the first inner radius is less than 7 mm, and the difference between the second outer radius and the second inner radius is less than 7 mm. In another embodiment, the differences are less than 5 mm.

As discussed above, in some embodiments, a majority 406 of the interior surface 300 and a majority 408 of the exterior surface 302 may be described as substantially parallel to a pseudo-spherical surface 400, and in other embodiments they may be described as being pseudo-spherical themselves. According to various embodiments, a majority 406 of the interior surface 300 and a majority 408 of the exterior surface 302, or at least the parts of those surfaces that overlap with each other, may be described as being bounded by a pseudo-spherical surface. In other words, according to various embodiments, the two surfaces may be entirely separated by a pseudo-spherical surface. In other embodiments, parts of one of the surfaces may project through a pseudo-spherical surface separating the interior surface 300 from the exterior surface 302, but do not interfere with the rotation of one liner with respect to the other.

Advantageous over conventional helmets that employ spherical liners to absorb rotational energy, the use of pseudo-spherical liners such as those described herein may be adapted to a variety of helmet types. For example, the non-limiting embodiment shown in FIGS. 4 and 5 is a bike helmet. These methods may be applied to any other helmet known in the art that may be used to protect against injuries due to rotational forces.

As stated before, the radii of the two cross sections of a pseudo-spherical surface are not equal. The ratio of one radius to another may be adjusted, depending on the overall shape of the helmet. For example, the non-limiting embodiment of a helmet 200 shown in FIGS. 2-5 is roughly 20% longer than it is wide, which more closely resembles the shape of a human head than a sphere. Specifically, in that embodiment, the first radius 404 is roughly 93 mm and the second radius 502 is roughly 118 mm. Other embodiments may have radii of other sizes, to fit larger or smaller heads, or to be adapted to a different helmet design.

As shown in FIG. 3, the outer liner 202 comprises a plurality of vents 304 that pass through the outer liner 202, and the inner liner 204 comprises a plurality of channels 306 that pass through the inner liner 204. As shown in FIGS. 4 and 5, the plurality of vents 304 at least partially overlap with the plurality of channels 306 to form a plurality of apertures 410 from outside the helmet to inside the helmet. According to various embodiments, the exterior surface 302 of the inner liner 204 and the interior surface 300 of the outer liner 202 may not be continuous, and may comprise vents, channels, openings, and/or other features which introduce voids in the surfaces. In some embodiments, including the non-limiting example shown in FIGS. 3 through 5, such voids may provide fluid communication between outside the helmet and a user's head, improving ventilation while the helmet is in use. In other embodiments, such voids may be employed to reduce the overall weight of a helmet. In still other embodiments, such voids may be employed for other reasons. While the following discussion will be in the context of vents 304 and channels 306, it should be recognized that the methods and structures described may be applied to any other void in a rotation surface (e.g. exterior surface 302 of the inner liner 204, interior surface 300 of the outer liner 202, etc.).

While use of vents 304 and channels 306 in helmets is well known in the art, an elastically deformable inner liner 204 slidably coupled to the inside of an outer liner 202 presents an issue not faced by conventional helmets. Therefore, according to various embodiments, the edges (i.e. the boundary where the liner surface tips inward to start a void in the surface) of vents 304 are shaped at the interior surface 300 and the edges of channels 306 are shaped at the exterior surface such that rotation of the outer liner 202 with respect to the inner liner 204 is not impeded (e.g. the edge of a vent getting caught on the edge of a channel, etc.).

In some embodiments, including the non-limiting example shown in FIGS. 2-5, the vents 304 are beveled at the interior surface 300 of the outer liner 202, and the channels are beveled at the exterior surface 302 of the inner liner 204. In the context of the present description and the claims that follow, beveled means having a sloping edge. Examples of a sloping edge include but are not limited to one or more angled planes, and a curved surface. Thus, a vent 304 beveled at the interior surface 300 would, at least initially, narrow as it extends through the outer liner 202.

Alternatively, in some embodiments, the edges of voids in a rotational surface of a liner simultaneously represent local minima for the rotational surface and local maxima for the surfaces making up the void, where minima and maxima are describing distance from a pseudo-spherical surface associated with the liner and the second liner it rotates against.

As noted above, attenuation of rotational energy occurs when the exterior surface 302 of the inner liner 204 and the interior surface 300 of the outer liner 202 rotate against each other. In various embodiments, one or more of these surfaces may be modified to facilitate that rotation. For example, in one embodiment, the exterior surface 302 of the inner liner 204 may comprise a surface of reduced friction 310, having been treated with a material to decrease friction. Materials include, but are not limited to, in-molded polycarbonate (PC), an in-molded polypropylene (PP) sheet, and/or fabric LFL. In other embodiments, a material or a viscous substance may be sandwiched between the two liners to facilitate rotation.

According to one embodiment, there may be an air gap 508 of roughly 0.5 mm between the two liners, to help allow for movement. In another embodiment, the air gap 508 between the two liners may range from 0.3 mm to 0.7 mm. In other embodiments, there may be other distances of gap 508 between the two liners.

FIG. 5 depicts a non-limiting example of a sagittal cross section of the helmet 200. As shown, the outer liner 202 has an undercut ridge 504 on each side of the liner (only one is visible in FIG. 5). In the context of the present description and the claims that follow, a ridge is a part of the interior surface 300 of the outer liner 202 that protrudes out enough to keep the inner liner 204 from easily sliding out of the outer liner 202. In some embodiments, the inner liner 204 is in contact with one or more ridges 504 on the interior surface 300 of the outer liner 202.

According to various embodiments, the ridge 504 serves to lock the inner liner 240 in place after it is popped inside the outer liner 202, and provides a hard stop to the motion, be it rotational or linear, of the inner liner 204 with respect to the outer liner 202. Other embodiments may include additional, or different, structures, surfaces, bumpers, and/or features to constrain the motion of the inner liner 204 relative to the outer liner 202 to desired bounds. In one embodiment, at some points the inner liner 204 may be fixed in place, while at others it may move freely.

In some embodiments, a ridge 504 may be mated with an edge 506 of the inner liner 204. In other embodiments, a ridge 504 may be shaped to capture, cup, or wrap around an edge 506 of the inner liner 204 it is close to.

In some embodiments, the elastic nature of the inner liner is such that it may be returned to a pre-impact geometry without external forces. In other embodiments, additional forces may be needed to return the inner liner to a pre-impact geometry. See, for examples, the return spring 510 of FIG. 5. According to various embodiments, the inner liner 204 may be directly coupled to the interior surface 300 of the outer liner 202 through at least one return spring 510, which returns the inner liner 204 back to a pre-impact position after an impact.

A return spring 510 may be composed of a variety of elastic materials, including but not limited to an elastomer such as silicone. According to various embodiments, a return spring 510 may have a variety of shapes, including but not limited to bands, cords, and coils. In some embodiments, one or more return springs 510 may directly couple an edge 506 of the inner liner 204 to the interior surface 300 of the outer liner 202. In other embodiments, one or more return springs 510 may directly couple the outer liner 202 to locations on the exterior surface 302 of the inner liner 204 that are not proximate an edge 506 of the inner liner 204. Both of these examples are illustrated in FIG. 5 and one, the other or both examples of locations for coupling the return springs 510 may be used in particular helmet embodiments.

Where the above examples, embodiments and implementations reference examples, it should be understood by those of ordinary skill in the art that other helmets and examples could be intermixed or substituted with those provided. In places where the description above refers to particular embodiments of helmets and design methods, it should be readily apparent that a number of modifications may be made without departing from the spirit thereof and that these embodiments and implementations may be applied to other helmets as well. Accordingly, the disclosed subject matter is intended to embrace all such alterations, modifications and variations that fall within the spirit and scope of the disclosure and the knowledge of one of ordinary skill in the art.

What is claimed is:

1. A helmet, comprising:

an outer liner having an interior surface defining a first coronal cross-sectional curvature and a first sagittal cross-sectional curvature different from the first coronal cross-sectional curvature, the outer liner comprising a plurality of vents passing through the outer liner wherein each of the plurality of vents is beveled at the interior surface of the outer liner with a curved edge;

an inner liner slidably disposed within the interior surface of the outer liner and slidably coupled thereto, the inner liner having an exterior surface defining a second coronal cross-sectional curvature and a second sagittal cross-sectional curvature different from the second coronal cross-sectional curvature, the inner liner comprising a plurality of channels passing through the inner liner wherein the plurality of channels are in fluid communication with the plurality of vents and each of the plurality of channels is beveled at the exterior surface of the inner liner with a curved edge;

wherein a majority of the interior surface of the outer liner and a majority of the exterior surface of the inner liner are substantially parallel to a pseudo-spherical surface separating the interior surface from the exterior surface defining a third coronal cross-sectional curvature and a third sagittal cross-sectional curvature different from the third coronal cross-sectional curvature and wherein parts of one of the interior surface of the outer liner or the exterior surface of the inner liner project through the pseudo-spherical surface but do not interfere with the rotation of the outer liner with respect to the inner liner; and wherein the inner liner is elastically deformable along the interior surface of the outer liner in response to rotation of the outer liner relative to the inner liner caused by an impact to the helmet.

2. The helmet of claim 1, wherein the outer liner has a density greater than the density of the inner liner and the inner liner has a density less than 70 g/L.

3. The helmet of claim 1, wherein the third coronal cross-sectional curvature defines a first radius of curvature and the third sagittal cross-section sectional curvature defines a second radius of curvature different from the first radius of curvature.

4. The helmet of claim 3, wherein the difference between the first radius of curvature and the second radius of curvature is less than about 5 mm.

5. The helmet of claim 1, wherein the inner liner is coupled to the interior surface of the outer liner through at least one return spring, the at least one return spring comprising an elastomer material.

6. The helmet of claim 1, wherein at least one of the interior surface of the outer liner and the exterior surface of the inner liner is treated to reduce friction of the exterior surface of the inner liner slidably coupled to the interior surface of the outer liner.

7. The helmet of claim 1, wherein an air gap exists between a majority of the exterior surface of the inner liner and the interior surface of the outer liner.

8. The helmet of claim 1, wherein the outer liner has an exterior surface coupled to an outer shell.

* * * * *